US005286028A

United States Patent [19]

Daugard

[11] Patent Number: 5,286,028

[45] Date of Patent: Feb. 15, 1994

[54] GOLF SWING TRAINING SYSTEM

[76] Inventor: Craig D. Daugard, 1170 Greenway Ter., #2, Brookfield, Wis. 53005

[21] Appl. No.: 23,082

[22] Filed: Feb. 26, 1993

[51] Int. Cl.[5] ..... A63B 69/36

[52] U.S. Cl. ..... 273/176 FA; 273/184 B; 273/193 R; 273/200 A; 273/191 B; 273/185 B; 273/185 C; 273/DIG. 30; 273/196; 273/195 A; 273/186.1

[58] Field of Search ..... 273/176 FA, 184 B, 200 A, 273/193 R, 191 B, 185 C, 185 B, DIG. 30, 196, 186.1

[56] References Cited

U.S. PATENT DOCUMENTS

| | | | |
|---|---|---|---|
| D. 332,476 | 1/1993 | Daugard | D21/214 |
| 1,224,410 | 5/1917 | Porte | 273/200 A |
| 1,907,412 | 5/1933 | Zimmer | 273/200 A |
| 2,340,793 | 2/1944 | Chapman | 273/192 |
| 2,680,022 | 6/1954 | Walden | 273/200 A |
| 3,234,794 | 2/1966 | Owen | 273/184 B |
| 3,469,840 | 9/1969 | Kruzel | 273/26 |
| 3,550,937 | 12/1970 | Wright et al. | 273/58 C |
| 3,558,134 | 1/1971 | Hoitsma | 273/26 |
| 3,754,761 | 8/1973 | Pruss | 273/200 A |
| 3,953,028 | 4/1976 | Gowins | 273/200 AX |
| 4,944,513 | 7/1990 | Zentner | 273/26 R |

*Primary Examiner*—George J. Marlo

*Attorney, Agent, or Firm*—Andrus, Sceales, Starke & Sawall

[57] ABSTRACT

A golf swing training system consists of a line having first and second ends, and a line support connected to each end of the line. A first line support positions the line closely adjacent a supporting surface, such as the floor or the ground, and a second line support positions the opposite of the line above the supporting surface. A ball is slidably mounted to the line. A golf club includes a head having a vertical slot extending upwardly from the lower surface of the head. The ball is positioned on the portion of the line adjacent the supporting surface, and a user then swings the club toward the line such that the line is received within the slot formed in the golf club head, to strike the ball and to propel the ball along the line. A spring is mounted to the line adjacent the second line support, and the ball engages the spring as it approaches the second line support to propel the ball back along the line toward the user. When the club is swung properly, the line is received within the slot formed in the golf club head, and there is little interference between the line and the golf club head. When the golf club is swung improperly, the portions of the club head adjacent the slot engage the line to set up oscillations within the line, and as a result the ball does not travel smoothly along the line, to provide immediate feedback to the user as to the quality of the swing.

15 Claims, 2 Drawing Sheets

GOLF SWING TRAINING SYSTEM

BACKGROUND AND SUMMARY

This invention pertains to sporting and recreational equipment, and more particularly to a line-type apparatus and method for use in recreation and training.

Line-type recreational systems and training are known, and typically include a line extending between a pair of spaced stationary objects, and a ball or other object slidably mounted to the line. A player stands adjacent one end of the line, and the ball is propelled toward the player. The player holds a striking implement and swings the implement toward the line as the ball approaches the player, for striking the ball as it moves on the line and propelling the ball in the opposite direction on the line.

One system of this type is disclosed in Zentner U.S. Pat. No. 4,944,513. This patent discloses the line being strung between stationary objects such as upright posts or trees, and discloses the striking implement as a pronged bat or racket.

It is an object of the present invention to provide an improved line-type recreational and training apparatus and method for practicing and improving a person's golf swing. It is a further object of the invention to provide a golf swing training apparatus and method which is capable of closely replicating golfing conditions. Yet another object of the invention is to provide a golf swing training apparatus and method adapted to be played alone and providing rapid repeatability, and which can be played either indoors or outdoors. A still further object of the invention is to provide a means for determining the velocity of the ball as it travels on the line.

In accordance with one aspect of the invention, a golf swing training system includes a line defining a first end and a second end, and first and second line supports connected to the first and second ends of the line, respectively. The first and second line supports are mounted to a supporting surface, and are arranged such that a first portion of the line adjacent the first line support is located closely adjacent the supporting surface and a second portion of the line adjacent the second line support is spaced above the supporting surface. A ball is slidably mounted to the line. The system further includes a golf club defining a shaft and a head having a slot formed therein. The slot extends upwardly from a lower surface defined by the head A user stands adjacent the first portion of the line, grasps the golf club shaft, and swings the golf club toward the line such that the line is received within the slot extending upwardly from the lower surface of the golf club head. In this manner, the golf club head strikes the ball and propels the ball on the line upwardly on the second portion of the line toward the second line support.

When the golf swing training apparatus is in outdoor use, the first line support is in the form of a ground-penetrating stake for connection to the first end of the line. The second line support consists of a base and an upright member extending upwardly from the base. The base is placed on the ground and anchored thereto by use of weighted members placed on the base. For indoor use, the first line support is in the form of a suction cup assembly connected to the first end of the line and removably engageable with the floor, to support the first portion of the line adjacent the floor. An artificial turf member is removably mounted to the floor below the first portion of the line, and the ball is placed over the artificial turf member to simulate outdoor conditions. A removable connection arrangement is provided for removably mounting the artificial turf member to the floor. The second line support consists of a base and an upright member mounted to and extending upwardly from the base, and one or more suction cups mounted to the base for removably mounting the second line support to the floor.

A spring is mounted to the second end of the line, which is connected to the upright member. The spring functions to engage the ball as it travels toward the upright member, and propels the ball away from the upright member back toward the user.

The invention further contemplates a golf swing training method, substantially in accordance with the foregoing summary.

In accordance with another aspect of the invention, a velocity measuring device is mounted adjacent the line to measure the velocity of the ball as the ball is propelled on the line in response to striking of the ball with the golf club head. The velocity measuring device may be in the form of a tubular member defining an internal passage through which the line extends, and first and second detectors for detecting the ball as it passes on the line through the internal passage of the tubular member. A velocity determining device is responsive to the first and second detectors for determining the velocity of the ball. In one form of the invention, the velocity of the ball is converted by a distance computing device to a value representative of the distance which would have been traveled by an actual golf ball, corresponding to the measured velocity of the ball on the line. A readout of the distance which would have been traveled by an actual golf ball is provided. In another form of the invention, the velocity measuring device and the distance computing device are interconnected with a video monitor. A golf game simulating program is provided for simulating a golf game on the video monitor device. With this arrangement, a user can simulate playing a golf game.

The invention further contemplates a line game method substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
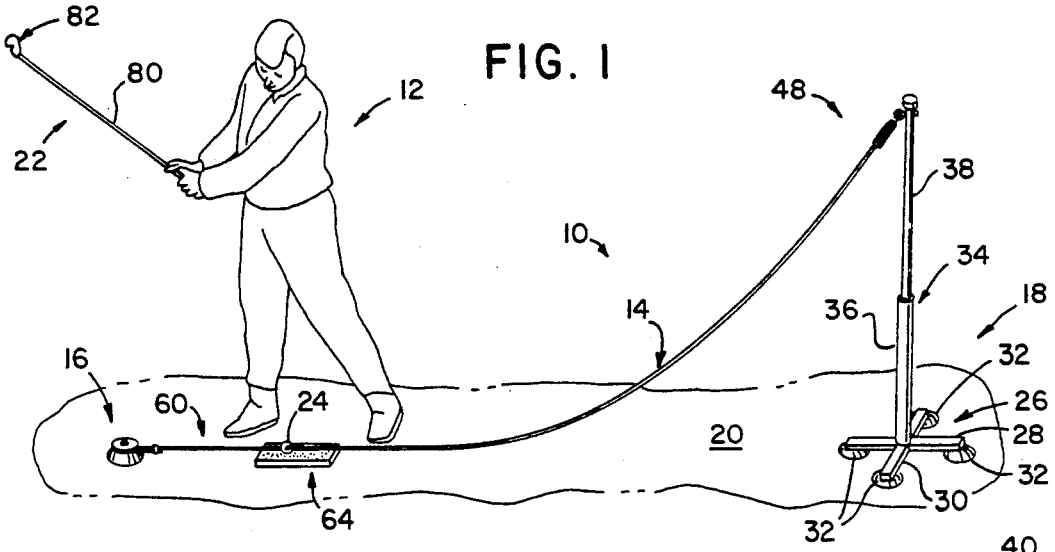
FIG. 1 is an isometric view showing the golf swing training system of the invention set up in an indoor environment.

FIG. 1 illustrates a golf swing training system constructed according to the invention, for use by a player 12. FIG. 1 shows golf swing training system 10 set up in an indoor environment. Broadly, golf swing training system 10 includes a line 14 defining opposite ends, a first line support 16 to which one end of line 14 is connected, and a second line support 18 to which the opposite end of line 14 is connected. Line supports 16, 18 are mounted to a supporting surface such as a floor 20. Golf swing training system 10 further includes a golf club 22, the construction of which will later be explained. A ball 24 is slidably mounted to line 14 by means of an axial passage extending through ball 24.

With further reference to FIG. 1, line support 18 consists of a base 26 having right-angle base members 28, 30. Suction cups 32 are mounted to the undersides of base members 28, 30 adjacent the ends of base members 28,.30. Upon application of a downward vertical force on base 26 toward floor 20, suction cups 32 function to mount line support 18 to floor 20 for retaining line support 18 in a desired position.

An upright member 34 extends upwardly from base 26 at the intersection of base members 28, 30. Upright 34 consists of a lower tubular member 36 and an upper member 38 mounted for telescoping movement relative to tubular lower member 36. A variable height mechanism (not shown) is interposed between lower tubular member 36 and upper member 38, for adjusting the height of upper member 38 relative to floor 20. For example, a series of vertically spaced holes can be formed in the upper end of lower tubular member 36 and in upper member 38, and a bolt or the like is inserted through the aligned holes in members 36, 38 in a manner as is known to adjustably fix the position of upper member 38 relative to lower tubular member 36.

Figure 2:
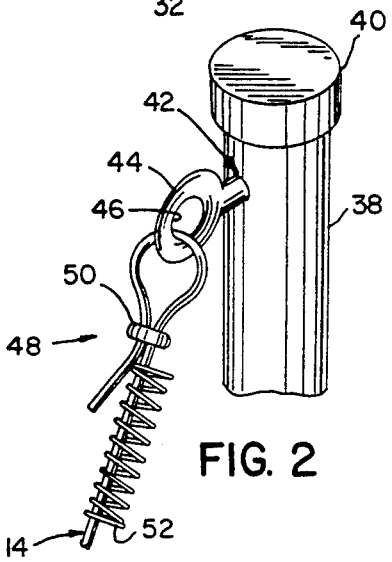
FIG. 2 is a partial isometric view showing connection of the second end of the line to the upright member provided on the second line support.

Referring to FIG. 2, a cap 40 is mounted to the upper end of upper member 38. An eye-bolt 42, including a circular eye 44 defining an opening 46, is connected to upper member 38 just below cap 40. The shank of eye bolt 42 extends through aligned openings formed in upper member 38, and a nut is secured to the threaded end of the shank of eye-bolt 42 to mount eye-bolt 42 to upper member 38.

One end of line 14, shown generally at 48, is connected to upper member 38 by means of eye-bolt 42. The end of line 14 is threaded through eye-bolt opening 46, and a clevis 50 is clamped onto facing contiguous areas of line 14 to secure line end 48 to eye-bolt 42. A spring 52 is placed between the contiguous portions of line 14 adjacent clevis 50, and a clamping force exerted on the facing portions of line 14 by clevis 50 functions to retain spring 52 in place on line 14 adjacent clevis 50.

With this arrangement, end 48 of line 14 is elevated above floor 20. The elevation of line end 48 can be adjusted by varying the height of upper member 38 relative to lower member 36.

Figure 3:
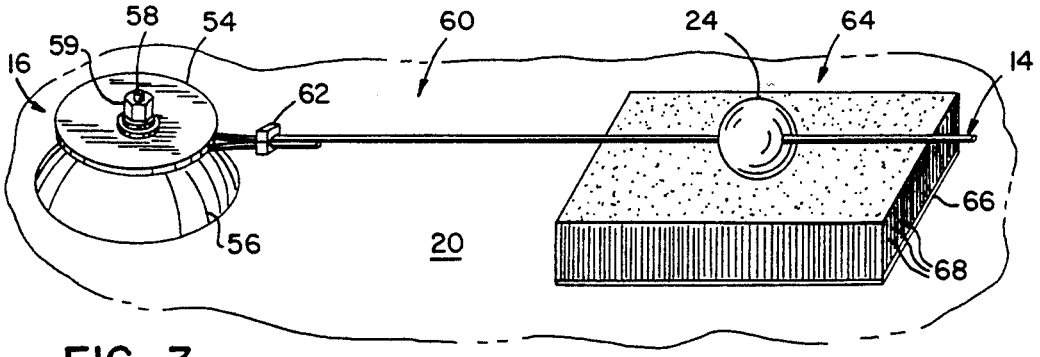
FIG. 3 is a partial isometric view showing engagement of the first end of the line with the first line support and placement of an artificial turf member below the line for simulating outdoor conditions.

Referring to FIG. 3, line support 16 includes a disc 54 having a suction cup 56 mounted to its underside. A bolt 58 extends through aligned openings in disc 54 and suction cup 56, and a nut 59 is engaged with bolt 58. A set of conventional washers are placed between nut 59 and the upper surface of disc 54.

The end of line 14 opposite end 48, shown generally at 60, is connected to line support 16 at the space between disc 54 and suction cup 56. A loop is formed in the end of line end portion 60 by means of a clevis 62. The loop is then engaged between disc 54 and suction cup 56, with bolt 58 functioning to retain the looped end of line end portion 60 in engagement with line support 16.

With this arrangement, end 60 of line 14 is located closely adjacent floor 20.

Representatively, line end portion 60 is appproximately 1½ inches above floor 20, and line end portion 48 is 3 to 5 feet above floor 20. Line supports 16, 18 are positioned such that lien 14 assumes a position as shown in FIG. 1, in which line 14 remains in close proximity to floor 20 for several feet in front of line support 16. Line 14 then curves gently upwardly toward the upper end of upper member 38 of line support 18, terminating in line end portion 48 connected thereto.

Figure 4:
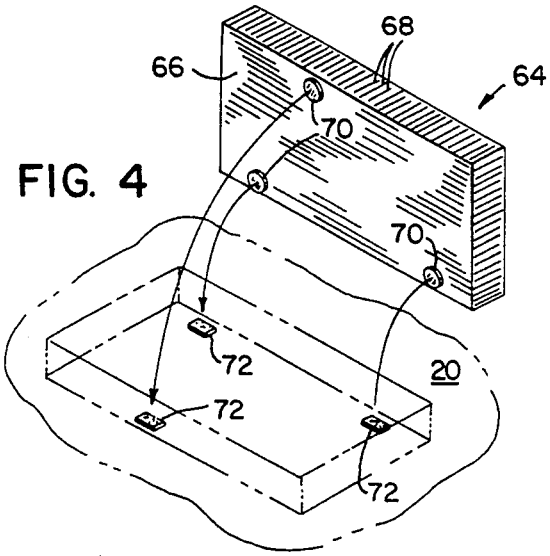
FIG. 4 is a partial isometric view showing the manner in which the artificial turf member is removably mounted to the floor.

As shown in FIGS. 1, 3 and 4, an artificial turf member 64 is mounted to floor 20 forwardly of line support 16, and is disposed between line end portion 60 and floor 20. Artificial turf member 64 consists of a base 66 and a series of upstanding artificial grass blades 68. As shown in FIG. 4, a hook-and-loop connection arrangement is provided for temporarily securing artificial turf member 64 to floor 20. A series of hook members 70 are mounted to the underside of artificial turf member base 66, and a series of loop members 72 are mounted to floor 20. Engagement of hook members 70 with loop members 72 retains artificial turf member 64 in a desired position on floor 20.

Artificial turf member 64 is placed approximately two feet in front of line support 16 adjacent end portion 60 of line 14.

Figure 5:
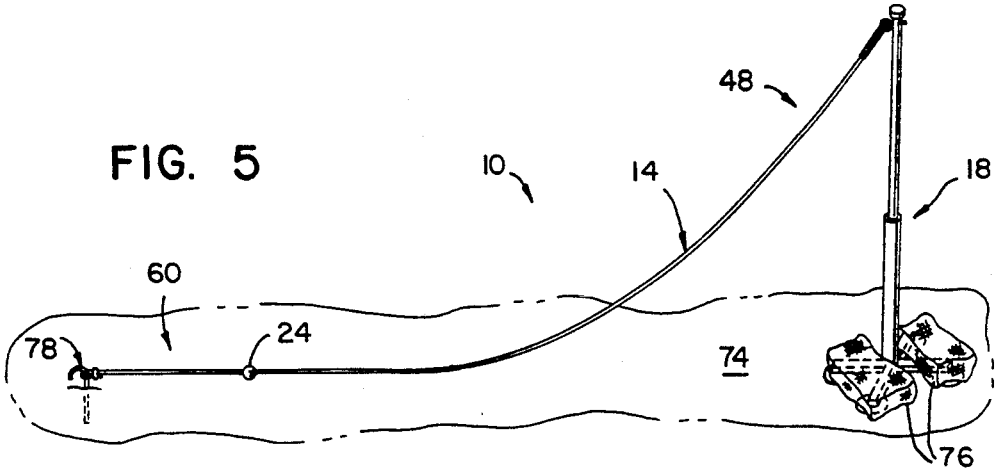
FIG. 5 is a view similar to FIG. 1, showing the golf swing training system of the invention set up in an outdoor environment.

FIG. 5 illustrates golf swing training system 10 in an outdoor environment, in which natural turf 74 provides the supporting surface on which golf swing training system 10 is employed. In this arrangement, line support 18 is constructed as described previously, but is retained in place on turf 74 by a pair of weighted sacks 76, such as sandbags or the like, placed .on base members 28, 30. A stake 78, having a vertical ground penetrating portion and a curved upper end, is employed to fix line end portion 60 in a desired position at a location spaced from line support 18. The curved portion of stake 78 extends through the loop formed in line 14 at the end of line end portion 60, functioning to retain line end portion 60 in place when the vertical portion of stake 78 is driven into turf 74.

Figure 6:
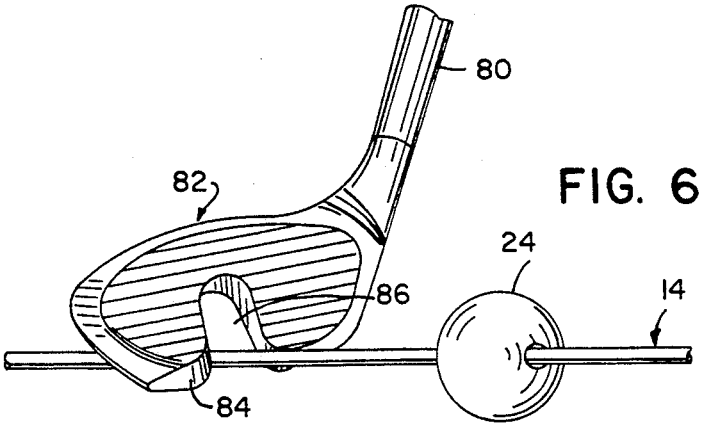
FIG. 6 is a partial isometric view showing the line being received within the slot formed in the golf club head during a swing of the golf club for striking the ball with the golf club head.

Referring to FIGS. 1 and 6, golf club 22 includes a shank 80 and a head 82. Head 82 defines a lower surface 84 having a slot 86 formed therein, extending vertically upwardly from lower surface 84. Slot 86 is positioned on club head 82 so as to be located substantially centrally along the face of club head 82.

In operation, golf swing training system 10 functions as follows. User 12 first positions ball 24 on line 14 such that ball 24 is located 2 to 3 feet in front of line support 16 (FIG. 1) or stake 78 (FIG. 5). In indoor use, ball 24 is positioned over artificial turf member 64, as shown in FIG. 3. In outdoor use, ball 24 rests on the grass of turf 74. With ball 24 in a desired position on line end portion 60, user 12 then stands adjacent line end portion 60 in a conventional golf stance, grasping the handle provided at the end of golf club shank 80. User 12 then employs a golf swing motion to strike ball 24 with club head 82, during the downward portion of the golf swing. As club head 82 approaches ball 24, line 14 is received within slot 86 formed in club head 82 as shown in FIG. 6. The face of club head 82 then strikes ball 24 to propel ball 24 along line 14, such that ball 24 travels along the upward curved portion of line 14 toward line end 48. As ball 24 approaches line end 48, ball 24 engages spring 52 which then compresses and functions to propel ball 24 back along line 14 in a direction toward user 12. User 12 then employs golf club head 82 to draw ball 24 along line 14. to a desired position in front of user 12, in preparation for a subsequent swing at ball 24.

During an ideal swing, line 14 is received within club head slot 86 as club head 82 approaches ball 24 and remains within slot 86 during striking of ball 24 and during the follow-through portion of the swing. As long as user 12 swings club 22 such that club head 82 follows a desired straight-line path, there is minimal engagement between line 14 and the portions of club head 82 adjacent slot 86. Ball 24 thus travels smoothly along line 14 toward line end 48. However, if club 22 is not swung properly to provide straight-line movement of club head 82 during striking of ball 24, club head 82 will engage line 14 and set up oscillations of line 14. When this occurs, ball 24 does not travel smoothly along line 14 due to interference between line 14 and the walls of the passage through ball 24. User 12 is thus provided with immediate feedback that the swing was improper, and can make adjustments as desired until a proper swing is attained.

Golf swing training system 10 thus functions to improve a person's ability to hit a golf ball straight, by teaching a person to lay the center of the club face on the back center of the golf ball. At the same time, system 10 teaches a person to hit down and through the golf ball, which is an important basic in learning a proper golf swing.

Figure 7:
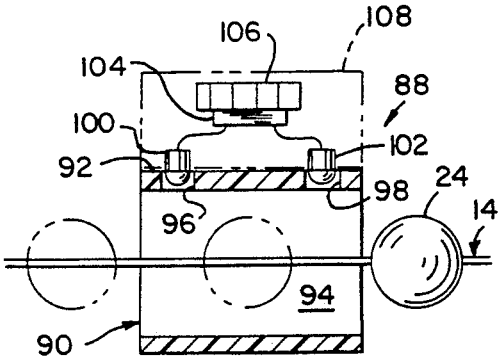
FIG. 7 is a partial sectional view showing a velocity measuring device for use with the golf swing training system of FIGS. 1 and 5.

FIG. 7 illustrates a velocity measuring device, shown generally at 88, for use in combination with golf swing training system 10 or any other line game or training apparatus. Velocity measuring device 88 includes a tubular member 90 defining a side wall 92 and a passage 94. Tubular member 90 is positioned such that line 14 extends through passage 94. A pair of openings 96, 98 are formed in wall 92 of tubular member 90. Openings 96, 98 are spaced apart a predetermined distance.

A pair of photosensitive eyes 100, 102 are positioned within openings 96, 98, respectively. Eyes 100, 102 are interconnected with a microprocessor 104, which in turn is connected to a digital readout 106. Components 100–106 are contained within a housing, shown schematically at 108.

In operation, velocity measuring device 88 is placed by user 12 a predetermined distance from the striking location at which ball 24 is placed on line 24. As ball 24 travels along line 14 in response to being struck by 82, ball 24 passes through passage 94. Each of eyes 100, 102 provides a signal to microprocessor 104 as ball 24 passes adjacent each eye 100, 102. Microprocessor 104 includes a clock, and with eyes 100, 102 being spaced a predetermined distance apart, functions to compute the velocity of ball 24 as it travels on line 14 through passage 94. Microprocessor 104 is programmed to calculate a projected distance an actual golf ball would have traveled corresponding to the calculated velocity of ball 24 as it travels on line 14. Microprocessor 104 then sends a single to readout 106 to provide a visual indication of such distance to user 12. This distance readout provides additional feedback to user 12 as to whether the swing which propelled ball 24 along line 14 was a proper swing, and of the force with which ball 24 was struck.

Figure 8:
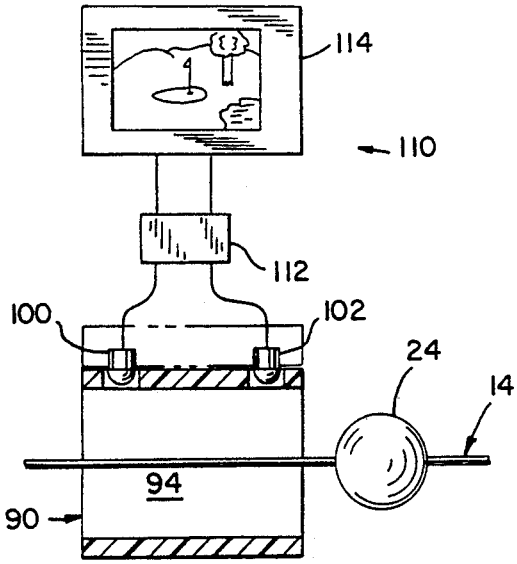
FIG. 8 is a view similar to FIG. 7, showing interconnection of the velocity measuring device with a video monitor device.

FIG. 8 schematically illustrates a video game system 110 for use with golf swing training system 10. As in velocity measuring device 88 of FIG. 7, system 110 of FIG. 8 includes photosensitive eyes 100, 102 for detecting ball 24 as it travels on line 14 through passage 94 of tubular member 90. Eyes 100, 102 are interconnected with a processor 112, which in turn is interconnected with a video monitor 114, such as a conventional television or computer monitor. As in velocity measuring device 88, microprocessor 112 functions to calculate a projected distance an actual golf ball would have traveled corresponding to the speed of ball 24 as it passes through passage 94. Video monitor 114 provides a visual image of a golf course. For instance, a video tape having images of an actual golf course can be played on a conventional video cassette player, to provide actual golf course images on a video monitor television. Alternatively, a computer program or game cartridge having simulated images of a golf course can be loaded into a computer or game processor, respectively,.to provide simulated golf course images on the screen of a computer monitor or a television. Based on an input from microprocessor 112 corresponding to the distance an actual golf ball would have traveled based on the speed of ball 24 on line 14, microprocessor 112 functions to change the video image on video monitor 114 in a manner providing a visual indication of the location of a golf ball on an actual or simulated golf course. User 12 can then adjust the force of the swing according to the distance from the green, to simulate the driving and chipping portions of an actual golf game. With appropriate programming, more than one player at a time can participate in a simulated golf game employing golf swing training system 10 and video game system 110.

With the arrangement of FIG. 8, user 12 can employ golf swing training apparatus 10 to simulate an actual golf game, providing an active form of indoor exercise.

Various alternatives and embodiments are contemplated as being within the scope of the following claims particularly pointing out and distinctly claiming the subject matter regarded as the invention.

I claim:

1. A golf swing training system, comprising:

a line defining a first end and a second end;

a first line support connected to the first end of the line and a second line support connected to the second end of the line, wherein the first line support and the second line support are mounted to a supporting surface and are arranged such that a first portion of the line adjacent the first line support is located closely adjacent the supporting surface and a second portion of the line adjacent the second line support is spaced above the supporting surface;

a ball slidably mounted to the line; and a golf club defining a shaft and a head having a slot formed therein, wherein the slot extends upwardly from a lower surface defined by the head;

wherein a user stands adjacent the first portion of the line and grasps the golf club shaft and swings the golf club toward the line such that the line is received within the slot formed in the golf club head adjacent the supporting surface, to strike the ball and to propel the ball on the line upwardly on the second portion of the line toward the second line support.

2. The golf swing training system of claim 1, wherein the supporting surface comprises the ground, and wherein the first line support comprises a ground-penetrating stake for connection to the first end of the line.

3. The golf swing training system of claim 2, wherein the second line support comprises a base and an upright member extending upwardly from the base, wherein the base is placed on the ground and anchored thereto by use of weighted members placed on the base.

4. The golf swing training system of claim 1, wherein the supporting surface comprises an indoor floor, and wherein the first line support comprises a suction cup assembly connected to the first end of the line and engageable with the floor to support the first portion of the line adjacent the floor.

5. The golf swing training system of claim 1, wherein the supporting surface comprises an indoor floor, and wherein the second line support comprises a base and an upright member mounted to and extending upwardly from the base, and one or more suction cups mounted to the base for removably mounting the second line support to the floor.

6. The golf swing training system of claim 1, wherein the supporting surface comprises an indoor floor, and further comprising an artificial turf member removably mounted to the floor below the first portion of the line and over which the ball is placed when the user swings the golf club toward the first portion of the line.

7. The golf swing training system of claim 6, wherein the artificial turf member is removably mounted to the floor by means of one or more first connector members mounted to the floor, and one or more mating second connector members mounted to a lower surface defined by the artificial turf member for removably mating with the one or more first connector members to removably mount the artificial turf member to the floor.

8. The golf swing training system of claim 1, wherein the second line support comprises a base and an upright member mounted to and extending upwardly from the base, wherein the second end of the line is connected to the upright member, and further comprising a spring mounted to the line adjacent its connection to the upright member for engaging the ball upon movement of the ball toward the upright member, and for propelling the ball away from the upright member.

9. The golf swing training system of claim 1, further comprising a velocity measuring device mounted adjacent the line to measure the velocity of the ball as the ball is propelled on the line by striking of the ball with the golf club.

10. The golf swing training system of claim 9, further comprising a video monitor device interconnected with the velocity measuring device, a distance converting device interposed between the video monitor device and the distance measuring device for converting to a distance value the velocity of the ball as the ball is propelled on the line, and a golf game simulating program for simulating a golf game on the video monitor device in response to swinging of the club to propel the ball on the line.

11. A golf swing training method, comprising the steps of:

positioning a line above a supporting surface such that a first portion of the line is located closely adjacent the supporting surface and a second portion of the line is spaced above the supporting surface;

slidably mounting a ball to the line; and standing adjacent a first portion of the line and swinging a golf club downwardly toward the ball when the ball is positioned on the first portion of the line, wherein the club includes a head defining a lower surface within which a slot is formed extending upwardly into the head, wherein the line is received within the slot adjacent the supporting surface and wherein striking of the ball with the golf club head functions to propel the ball on the line upwardly from the first portion of the line toward the second portion of the line.

12. A line game apparatus, comprising:

a line defining a first end and a second end;

a first line support connected to the first end of the line and a second line support connected to the second end of the line for supporting the line above a supporting surface;

a striking object slidably mounted to the line;

a striking implement for being grasped by a user and swung toward the line at the striking object for propelling the striking object on the line; and a velocity measuring device mounted adjacent the line to measure the velocity of the striking object as the striking object is propelled on the line in response to striking of the object by the striking implement.

13. The line game apparatus of claim 12, further comprising a video monitor device interconnected with the velocity measuring device, a distance converting device interposed between the video monitor device and the distance measuring device for converting the measured velocity of the striking object into a value representative of a distance based on the measured velocity of the striking object, and a game simulating program for simulating a game on the video monitor device in response to swinging of the striking implement to propel the striking object on the line.

14. The line game apparatus of claim 12, wherein the velocity measuring device comprises a tubular member defining an internal passage through which the line extends, first and second detectors mounted to the tubular member for detecting the striking object as it passes on the line through the internal passage defined by the tubular member, and velocity determining means responsive to the first and second detectors for determining the velocity of the striking object in response thereto.

15. A line game method, comprising the steps of:

positioning a line above a supporting surface;

slidably mounting a striking object to the line;

standing adjacent the line and swinging a striking implement toward the striking object on the line to propel the striking object along the line; and measuring the velocity of the striking object as the striking object travels along the line.

* * * * *